US010183791B2

(12) United States Patent
Friedrich et al.

(10) Patent No.: US 10,183,791 B2
(45) Date of Patent: Jan. 22, 2019

(54) CAP FOR A CONTAINER

(71) Applicant: Hoffmann-La Roche Inc., Little Falls, NJ (US)

(72) Inventors: Stefan Friedrich, Bassins (CH); Wigand Weirich, Grenzach-Wyhlen (DE)

(73) Assignee: Hoffmann-La Roche Inc., Little Falls, NJ (US)

( * ) Notice: Subject to any disclaimer, the term of this patent is extended or adjusted under 35 U.S.C. 154(b) by 41 days.

(21) Appl. No.: 14/913,678

(22) PCT Filed: Aug. 27, 2014

(86) PCT No.: PCT/EP2014/068113
§ 371 (c)(1),
(2) Date: Feb. 22, 2016

(87) PCT Pub. No.: WO2015/028482
PCT Pub. Date: Mar. 5, 2015

(65) Prior Publication Data

US 2016/0200488 A1 Jul. 14, 2016

(30) Foreign Application Priority Data

Aug. 27, 2013 (EP) ..... 13181833

(51) Int. Cl.
*B65D 51/00* (2006.01)
*B65D 41/44* (2006.01)

(52) U.S. Cl.
CPC ..... *B65D 51/002* (2013.01); *B65D 41/44* (2013.01); *B65D 2101/0023* (2013.01)

(58) Field of Classification Search
CPC ..... B65D 51/002; B65D 41/44; B65D 2101/0023; B65D 2101/0069;
(Continued)

(56) References Cited

U.S. PATENT DOCUMENTS 3,364,890 A * 1/1968 Andersen ..... B29C 43/18 215/DIG. 3
4,428,071 A * 1/1984 Wilmsmeyer ..... G11C 5/147 327/208
(Continued)

FOREIGN PATENT DOCUMENTS

CN 1230933 A 10/1999
CN 1826271 A 8/2006
(Continued)

OTHER PUBLICATIONS

International Search Report and Written Opinion Issued in PCT/EP2014/068113 dated Oct. 30, 2014.
(Continued)

*Primary Examiner* — James N Smalley
(74) *Attorney, Agent, or Firm* — Mintz Levin Cohn Ferris Glovsky and Popeo, P.C.

(57) ABSTRACT

A cap for a container comprising a ferrule to be fixedly attached to the neck of the container, the ferrule comprising an upper wall and a tubular skirt extending downwardly from the upper wall; a tamper evidence mechanism connected with the ferrule; an overseal button removably arranged on top of the upper wall of the ferrule so as to at least fully cover the tamper evidence mechanism, the overseal button being connected to the tamper evidence mechanism such that upon first removal of the overseal button the tamper evidence mechanism is irreversibly damaged. The overseal button comprises at least one translucent portion arranged to extend over the at least one portion of the tamper evidence mechanism which is irreversibly damaged upon first removal of the overseal button.

24 Claims, 4 Drawing Sheets

(58) Field of Classification Search
CPC ..... B65D 2101/0084; B65D 55/066; B65D 65/18; A61J 1/00
USPC ..... 215/247, 249, 230; 220/377; 604/415
See application file for complete search history.

(56) References Cited

U.S. PATENT DOCUMENTS 4,502,605 A * 3/1985 Wloszczyna ..... B65D 55/066 215/203
4,562,932 A * 1/1986 Finnern ..... B65D 51/002 215/249
4,747,499 A * 5/1988 Gach ..... B65D 51/145 215/250
5,105,959 A * 4/1992 Kinsley ..... B65D 55/026 215/227
5,405,031 A * 4/1995 Derksen ..... B65D 51/002 215/237
5,427,266 A * 6/1995 Yun ..... B65D 25/54 116/200
5,447,247 A * 9/1995 Derksen ..... B65D 51/002 215/235
2003/0029828 A1* 2/2003 Amschlinger ..... A61J 1/1412 215/247
2004/0020889 A1* 2/2004 Willemsen ..... B65D 55/066 215/230
2005/0252879 A1* 11/2005 Pedmo ..... B29C 45/164 215/365
2006/0092013 A1* 5/2006 Hager ..... B29C 45/14065 340/539.1
2006/0207959 A1* 9/2006 Woolston ..... A61J 1/062 215/320

FOREIGN PATENT DOCUMENTS

| | | | |
|---|---|---|---|
| CN | 101095176 | A | 12/2007 |
| CN | 101754906 | A | 6/2010 |
| EP | 0675 830 | B1 | 3/2000 |
| JP | 60-32264 | | 5/1985 |
| JP | 63-13860 | | 1/1988 |
| JP | 2004-67098 | A | 3/2004 |
| WO | WO-94/15850 | A1 | 7/1994 |
| WO | WO 98/15466 | | 4/1998 |
| WO | WO 2005/021400 | A1 | 3/2005 |
| WO | WO 2006/041965 | A2 | 4/2006 |
| WO | WO 2008/139196 | A1 | 11/2008 |

OTHER PUBLICATIONS

English Abstract of CN 101095176A.
English Abstract of CN 1826271A.
English Abstract of CN 101754906A.
English Abstract of CN 1230933A.
English Abstract of JP 2004-67098 (1 pg.).
English Abstract of JP 60-32264 (13 pgs).

* cited by examiner

CAP FOR A CONTAINER

CROSS-REFERENCE TO RELATED APPLICATIONS

This application is a national stage application, filed under 35 U.S.C. § 371, of International Application No. PCT/EP2014/068113 filed on Aug. 27, 2014, which claims priority to European Patent Application No. 13181833.8 filed on Aug. 27, 2013, the contents of each of which are hereby fully incorporated by reference.

BACKGROUND OF THE INVENTION

Field of the Invention

The present invention relates to a cap for a container in general, and has particular application in the field of vials, such as glass vials, containing a pharmaceutical product.

Background Art

Containers such as injection vials or cartridges comprising pharmaceuticals are increasingly becoming the target of counterfeiters. The counterfeiters either re-use already consumed original components or use standard packaging components which are available on the market and which are identical or look-alikes of the components used by the original product manufacturers.

Such vials or cartridges are typically made of glass or plastic and often have a standardized size and shape (without being limited to standardized sizes and shapes). The vials or cartridges typically have a neck having an opening which is sealed by a stopper (typically made of rubber) plugged into the opening of the neck to allow for a sterile storage of the liquid in the container. In order to access the pharmaceutical product in the interior of the container, a needle may be pierced through the rubber stopper, and the needle is then moved further into the interior of the container until the tip of the needle extends into the pharmaceutical product stored in the interior of the container. The pharmaceutical product can then exit from the interior of the container through the needle. For example, when using a syringe the syringe needle is pierced through the rubber stopper, and the container is then turned upside down to prevent air from being drawn into the syringe. The needle tip extends into the liquid, and the syringe plunger is then moved backwards thus creating an underpressure that causes the liquid to be drawn from the interior of the container into the syringe.

The container typically not only comprises the rubber stopper but in addition comprises a ferrule fixedly holding the rubber stopper in position to make sure that the container remains sealed so as to prevent the pharmaceutical product stored in the interior of the container from getting contaminated or being exposed to the ambient environment. The ferrule typically is a metal shell (e.g. made from aluminum) having an upper surface and a skirt depending downwards from the upper surface. The lower end of the skirt is crimped to engage a rim on the outer wall surrounding the opening of the container. Alternatively, the ferrule may be a plastic shell which is snapped on to engage the rim on the outer wall surrounding the opening. In both cases, the ferrule fixedly retains the stopper in place in the opening to keep the interior of the container sealed.

Attached to the ferrule before first use of the container is an overseal button that covers both the rubber stopper and the upper surface of the ferrule. Known overseal buttons are translucent and colorless in their entirety, or are opaque and colored. The color may represent the specific type of pharmaceutical product, or may represent a specific concentration of a pharmaceutical product. The overseal button is connected to a tamper evidence mechanism. To use the container for the first time, the user has to remove the overseal button from the ferrule in order to expose a central portion of the rubber stopper. Upon removal of the overseal button, the tamper evidence mechanism is irreversibly damaged. Typically, upon removal of the overseal button a centrally arranged circular portion of the upper surface of the rubber stopper is exposed so that subsequently a needle can be pierced through this exposed portion of the rubber stopper to allow the pharmaceutical product to exit from the interior of the container through the needle.

Counterfeiting may occur either by refilling the original container and re-arranging the overseal button of the original product manufacturer to again cover the upper surface of the ferrule and the (already damaged) tamper evidence mechanism, or by using a new container having a shape which is identical or very similar to that of the original container, and by re-arranging the overseal button of the original product manufacturer to cover the upper surface of the ferrule. Although this re-arrangement of the overseal button is not easy to perform, if it is done in a skillful manner the overseal button remains arranged on the upper surface of the ferrule and gives the user the impression that the container is a container from the original product manufacturer and has not been opened before. In case of an overseal button which is translucent and colorless in its entirety, the user may be able to determine whether the tamper evidence mechanism is damaged or not, however, there is no possibility to use the color of the overseal button for identifying the type of pharmaceutical product, the concentration, or whatever. In case of an overseal button which is opaque and colored in its entirety, the user may be able to identify the type of product, the concentration, or whatever, but cannot see whether the tamper evidence mechanism is damaged or not. Once the user has removed the overseal button (regardless of whether this has been done from the original product or from a counterfeit product), the tamper evidence mechanism is damaged in any event. Typically, upon first opening of the non-used container removal of the overseal button creates a sound, for example a "click" indicating that the tamper evidence mechanism has been irreversibly damaged. However, in case the re-arrangement of the overseal button is performed skillfully, upon removal of the re-arranged overseal button a "click" may also be created. Therefore, it is very difficult for the user to determine whether the respective "click" comes from a first removal of the overseal button from the ferrule or from the removal of a skilfully re-arranged overseal button from the ferrule—after removal of the overseal button the tamper evidence mechanism is damaged in any event.

Therefore, there exists a need for a cap that allows the user before removal of the overseal button to determine whether or not the container has not been opened before, while at the same time preserving the option to identify the product manufacturer on the overseal button and to use colors for identifying the type of product, the product concentration, or whatever.

SUMMARY OF THE INVENTION

The present invention suggests a cap as specified by the features of the independent claim directed to the cap. Embodiments of the cap according to the invention are the subject of the dependent claims. The present invention also includes a container comprising a cap according to the invention as specified by the features of the independent claim directed to the container.

The cap according to the invention comprises:

a ferrule to be fixedly attached to the neck of the container, the ferrule comprising an upper wall and a tubular skirt extending downwardly from the upper wall;

a tamper evidence mechanism connected with the ferrule;

an overseal button removably arranged on top of the upper wall of the ferrule in a manner so as to at least fully cover the tamper evidence mechanism, the overseal button being connected to the tamper evidence mechanism such that upon first removal of the overseal button from the ferrule at least a portion of the tamper evidence mechanism is irreversibly damaged.

The overseal button comprises at least one translucent portion arranged to extend over the at least one portion of the tamper evidence mechanism which is irreversibly damaged upon first removal of the overseal button from the ferrule. The overseal button further comprises an identification portion which is different from the at least one translucent portion in at least one property, and the at least one property is selected such that it allows for visual distinction of the identification portion and the at least one translucent portion.

The term "translucent portion" denotes a portion through which the user is able to visually determine whether or not the tamper evidence mechanism is damaged. For example, the translucent portion can be colorless or can be colored, as long as it allows the user to visually determine through the translucent portion whether or not the tamper evidence mechanism is damaged. As another example, the "translucent portion" can be polished or unpolished, as long as it allows the user to visually determine through the translucent portion whether or not the tamper evidence mechanism is damaged. Where possible from a constructional point of view, the term translucent portion is also meant to include one or more openings (which do not comprise a translucent material) through which the tamper evidence mechanism (or parts thereof) are visible to determine whether or not the tamper evidence mechanism is damaged.

The term "identification portion" denotes a portion which can be visually differentiated from the translucent portion. The identification portion is different from the translucent portion in at least one property which allows for the visual differentiation of the identification portion and the translucent portion. The user must be able to clearly determine where the identification portion starts and ends and where the translucent portion starts and ends. By way of example only, the translucent portion may be colorless and polished while the identification portion may be opaque and colored and may additionally have a considerable surface roughness, so that the color of the identification portion may be used to identify the type or concentration of a pharmaceutical product contained in the container while the translucent portion allows to determine whether or not the tamper evidence mechanism is damaged. Also, the identification portion may comprise information about the manufacturer of the product. For example, the name of the product manufacturer, a logo or a trademark of the product manufacturer (or combinations thereof) may be embossed in the colored opaque identification portion. In case the user observes through the translucent portion that the tamper evidence mechanism is damaged before the user has opened the container for the first time, this is an indication for the possibility that the container may have been opened before. At least the user cannot be sure, that the container has not been opened before. In particular in the case of pharmaceutical products, the pharmaceutical product contained in the container is then not administered to patients. On the other hand, in case the user observes through the translucent portion that the tamper evidence mechanism is not damaged, the user can be sure that the container has not been opened before. In the case of pharmaceutical products these products can then be administered to patients.

In some embodiment of the cap according to the invention the at least one property of the identification portion allowing for differentiation of the identification portion and the at least one translucent portion is selected from opacity, color, surface roughness, or combinations thereof. For example, the identification portion may be opaque and colored and the name of the product manufacturer, a logo or a trademark of the product manufacturer (or combinations thereof) may be embossed in the colored opaque identification portion. The translucent portion may be colorless and polished, however, the translucent portion can also be colored and may also have a visible surface roughness as long as it allows the user to visually determine through the translucent portion whether or not the tamper evidence mechanism is damaged.

In some embodiments of the cap according to the invention, the tamper evidence mechanism comprises a hub and the upper wall of the ferrule comprises an outer portion which is connected to the skirt and surrounds the hub of the tamper evidence mechanism. The hub of the tamper evidence mechanism is connected to the outer portion of the ferrule through a breakable connection. The overseal button comprises a clamping member and the hub comprises a through-opening which is centrally arranged in the hub, with the clamping member of the overseal button extending through the centrally arranged through-opening of the hub and clamping the overseal button to the hub of the tamper evidence mechanism.

In some embodiments of the cap according to the invention, the outer portion of the upper wall of the ferrule is an annular portion. The hub of the tamper evidence mechanism is a centrally arranged circular disc comprising the centrally arranged through-opening, and the centrally arranged through-opening has a circular shape.

In some further embodiments of the cap according to the invention, the breakable connection comprises one or more bridging webs which are connected to the hub of the tamper evidence mechanism as well as to the outer portion of the upper wall of the ferrule. Each individual bridging web is arranged at an individual angular position when viewed in circumferential direction, and the individual angular positions of the individual bridging webs (in case there are more than one bridging web) are different from one another.

In still some further embodiments of the cap according the invention, the breakable connection comprises at least four individual bridging webs, in particular at least six individual bridging webs. The individual bridging webs are arranged at equally spaced individual angular positions. The at least one translucent portion of the overseal button is arranged to extend over at least one of the bridging webs.

In yet some further embodiments of the cap according to the invention, the breakable connection comprises a scoring line connecting the centrally arranged hub of the tamper evidence mechanism to the outer portion of the upper wall of the ferrule. The translucent portion of the overseal button is arranged to extend at least partly over the scoring line.

In some embodiments of the cap according to the invention, the overseal button comprises an opaque colored outer ring, and the at least one translucent portion is surrounded by the opaque colored outer ring.

In some further embodiments of the cap according to the invention, the entire portion of the overseal button surrounded by the opaque colored ring forms the at least one translucent portion of the overseal button.

In still some further embodiments of the cap according to the invention, the overseal button comprises a centrally arranged opaque colored hub, and the at least one translucent portion of the overseal button is arranged between the centrally arranged opaque colored hub and the opaque colored outer ring.

In yet some further embodiments of the cap according to the invention, the centrally arranged opaque colored hub is connected to the opaque colored outer ring through at least one opaque colored web.

In still some further embodiments of the cap according to the invention, the at least one opaque colored web comprises a plurality of individual opaque spokes arranged to extend from the opaque colored hub to the opaque colored outer ring in a star-like manner.

In some other embodiments of the cap according to the invention, the at least one opaque colored web comprises a single opaque conical web. The narrow of end of the opaque conical web is connected to the opaque colored hub and the wide end of the conical web is connected to the opaque colored outer ring.

In some embodiments of the cap according to the invention, the overseal button comprises a circumferentially running translucent angular segment arranged in an otherwise completely colored opaque overseal button. The circumferentially running translucent angular segment is arranged to extend over the at least one portion of the tamper evidence mechanism which is irreversibly damaged upon first removal of the overseal button.

In some embodiments of the cap according to the invention, the overseal button is a two-component injection molded piece.

As has already been mentioned, in another aspect the invention relates to a container, in particular to a vial or a cartridge. The container comprises a neck having an opening for allowing access to the interior of the container. The container further comprises a sealing stopper which is arranged in the opening in the neck, and further comprises a cap according to the invention as it has been described in the embodiments above. The cap is arranged to cover the sealing stopper. The lower end of the skirt of the cap engages a rim on an outer wall of the neck of the container.

The invention has a number of advantages. First of all, the user can now always determine with certainty whether the tamper evidence mechanism of a container has been damaged or not before removing the overseal button. Thus, the user is at least able to determine whether or not the overseal button may have been removed from the ferrule before, regardless of the specific type of tamper evidence mechanism. This is particularly important in the field of healthcare where pharmaceutical products stored in such containers may be administered to patients. In case the user observes through the translucent portion of the overseal button that the tamper evidence mechanism is not damaged, the pharmaceutical product can be administered to patients. In case the user observes through the translucent portion of the overseal button that the tamper evidence is damaged, the pharmaceutical products should not be administered to patients.

By way of example, the ferrule can be made of metal (e.g. aluminum) and the skirt of the ferrule can be crimped to engage a rim on the outer wall of the neck of the container.

Alternatively, the ferrule can be made of plastic and can be snapped on. In the crimped or snapped on state, the skirt of the plastic ferrule engages the rim on the outer wall of the neck of the container.

Generally, the hub of the tamper evidence mechanism may have any geometrical shape and may be connected to the outer portion of the ferrule through any type of breakable connection. Advantageously, however, the hub is a circular disc having a central opening therein so that a clamping member of the overseal button may extend through the central opening of the circular disc. The overseal button is typically made of a thermoplastic material, and the clamping member may initially be a cylindrical wall projecting downwardly from the overseal button through the opening of the circular disc of the hub. The lower end of this cylindrical wall may then be heated and re-shaped so as to clamp the overseal button to the circular disc of the hub of the tamper evidence mechanism. The connection of the circular disc of the hub to the outer portion of the ferrule through bridging webs is a particularly reliable embodiment of the tamper evidence mechanism. While generally any number of such webs is possible, it may be advantageous to have four or six webs which are arranged at equally spaced angular positions when viewed in the circumferential direction. Removal or manipulation of the overseal button in any direction then reliably results in at least one of the webs getting broken, which can then visually be determined by the user. Alternatively, a circular scoring line can be used connecting the circular hub of the tamper evidence mechanism to the outer portion of the ferrule. In any of these embodiments, the translucent portion of the overseal button allows to view at least a portion of the tamper evidence mechanism which is irreversibly damaged during removal or manipulation of the overseal button, so that the user can easily determine that a container has not been opened in case the tamper evidence mechanism is completely intact.

Various embodiments of designs of the overseal button as regards the combination of color and translucent portions are possible. It is preferable, however, if the respective overseal button comprising both colored and translucent portions is a two-component injection molded piece. The two components may be a colored opaque plastic and a colorless translucent plastic which can be co-molded in a single molding process which allows for an efficient, economic and reliable manufacturing of the overseal button.

As has been mentioned already, while not being limited to specific containers, the cap according to the invention has particular application in the field of vials or cartridges in which pharmaceutical products (such as drugs) are stored which are used in the field of healthcare where such pharmaceutical products are administered to patients.

BRIEF DESCRIPTION OF THE DRAWINGS

Further advantageous aspects of the invention become apparent from the following detailed description of embodiments of the invention with the aid of the drawings in which.

DETAILED DESCRIPTION OF EMBODIMENTS

Figure 1:
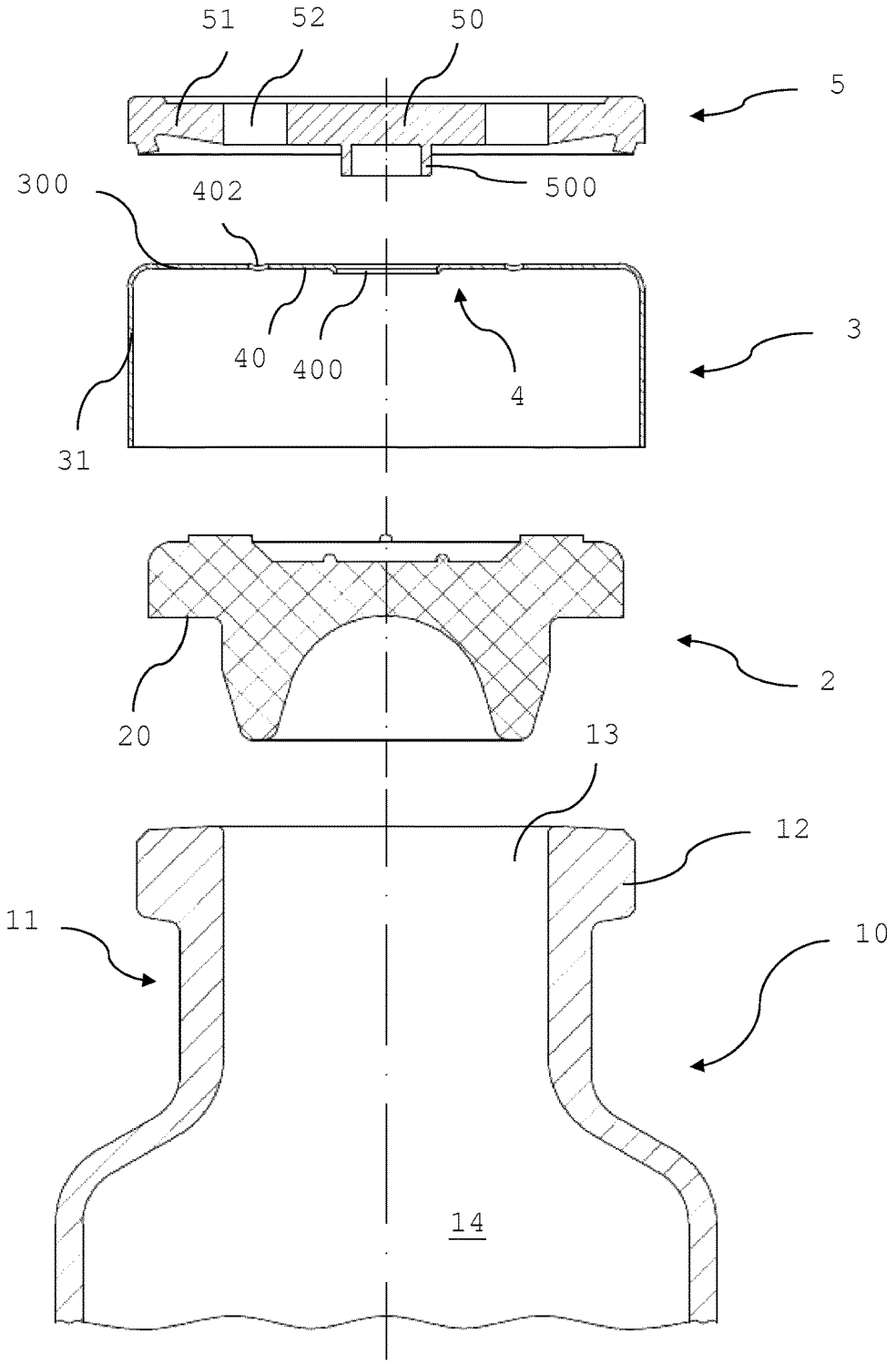
FIG. 1 an exploded view of an embodiment of a container comprising a sealing stopper and a first embodiment of the cap according to the invention.
Figure 2:
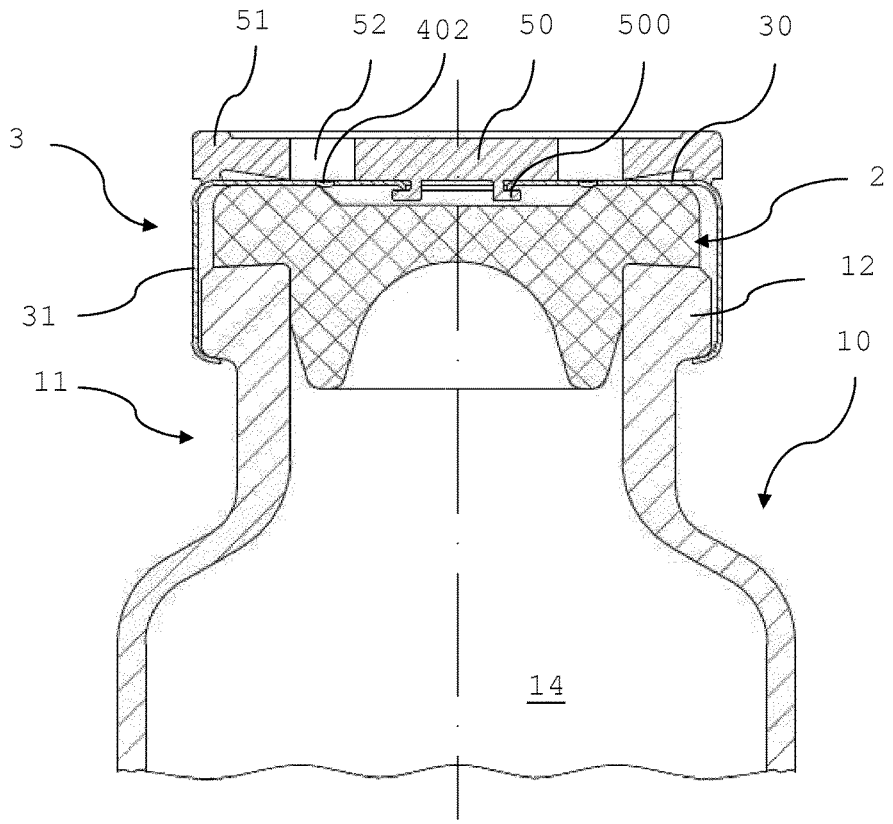
FIG. 2 a sectional view of the embodiment of the container of FIG. 1, with the components of the exploded view of FIG. 1 being shown in an assembled state.
Figure 3:
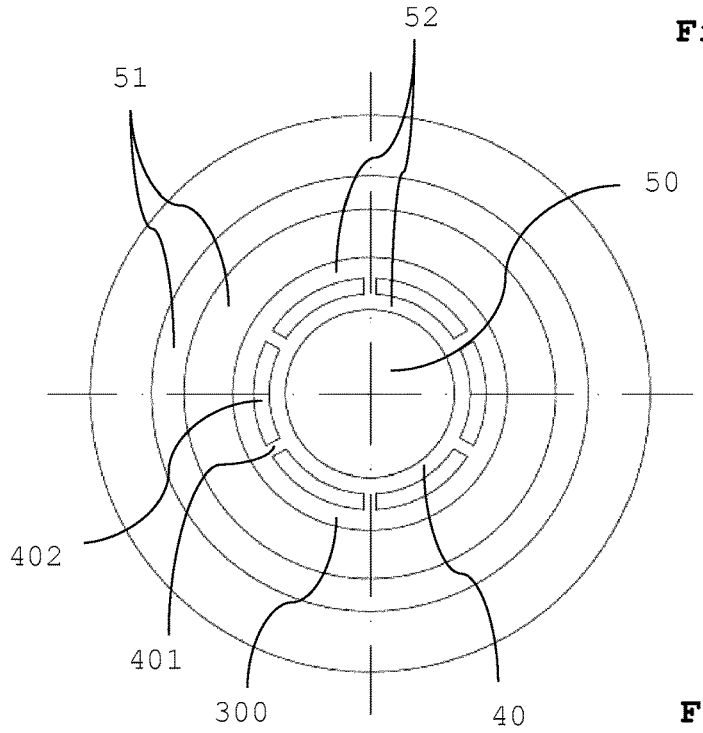
FIG. 3 a top view of the container of FIG. 2 with the first embodiment of the invention.

The embodiment of the container shown in FIG. 1 (exploded view) FIG. 2 (sectional view, assembled) and FIG. 3 (top view) comprises a vial 10 having a neck 11. The vial may be made of glass or any other suitable inert and mechanically stable material. On the outer wall of the neck 11 there is provided a rim 12. At its top end the neck 11 has an opening 13 for allowing access to the interior 14 of the container. For example, a pharmaceutical product such as a liquid drug to be administered to a patient can be stored in the interior 14 of such container.

The container further comprises a sealing stopper 2 which may be made of rubber or any other material suitable for gas-tight and liquid-tight sealing of the interior 14 of the container from the ambient environment. The container also comprises a first embodiment of a cap according to the invention. The cap comprises a ferrule 3, a tamper evidence mechanism 4 which is connected to the ferrule in a manner to be described in more detail below, and an overseal button 5.

The ferrule 3 comprises an upper wall 30 comprising an outer annular portion 300 and a tubular skirt 31 extending downwardly from the upper wall 30, or from the outer annular portion 300 respectively. The annular outer portion 300 is connected to the tubular skirt 31. Ferrule 3 is typically made of a deformable metal such as aluminum.

The tamper evidence mechanism 4 comprises a hub 40 in form of a circular disc which has a centrally arranged through-opening 400. The hub 40 is connected to the annular outer portion 300 of the upper wall of the ferrule 3 through a breakable connection. The breakable connection in this embodiment comprises six bridging webs 401 which are arranged at individual equally spaced angular positions (i.e. adjacently arranged bridging webs are angularly displaced relative to one another by an angle of 60°). Between the bridging webs 401 curved slots 402 are arranged spacing the bridging webs 401 angularly apart from one another.

The overseal button 5 is removably arranged on top of the upper wall 30 of the ferrule 3. In the embodiments shown, the overseal button 5 covers both the tamper evidence mechanism 4 to be described in more detail as well as the upper wall 30 of the ferrule 3. In the embodiment shown, the overseal button 5 comprises an opaque colored outer ring 51 and a centrally arranged opaque colored hub 50. Between the opaque colored outer ring 51 and the centrally arranged opaque colored hub 50 the overseal button 5 comprises an annular colorless and polished translucent portion 52 (no hatches being shown to emphasize that portion 52 is translucent). The overseal button 5 further comprises a centrally arranged clamping portion, which may comprise in its original non-deformed state a tubular skirt 500 extending downwardly from the opaque colored hub 50 (see FIG. 1). The colors of the opaque colored hub 50 and of the opaque colored outer ring 51 may be representative of a specific concentration of a substance contained in the container, or may be representative of the type of substance (e.g. for a specific type of drug), or of the specific manufacturer of the product.

For assembly of the cap comprising the ferrule 3, the tamper evidence mechanism 4 and the overseal button 5, first of all the overseal button 5 is placed on top of the tamper evidence mechanism 4 such that the tubular skirt 500 extends through the centrally arranged through-opening 400 of the hub 40 of the tamper evidence mechanism 4. Thereafter, the plastic material of the tubular skirt 500 can be heated and deformed such that it extends radially outwardly so that the hub 40 is clamped by the deformed skirt 500 (see FIG. 2).

To assemble the container, after the pharmaceutical product has been filled into the interior 14 of the vial 10 the sealing stopper 2 is pressed through the opening 13 into the neck 11 of the vial 10 until a radially extending flange 20 of the sealing stopper abuts against the upper surface of the rim 12. Thereafter, the cap is placed onto the sealing stopper 2 with the tubular skirt 31 of the ferrule 3 circumferentially enclosing the rim 12 provided on the outer wall of the neck 11. The cap is then pushed downwardly towards the sealing stopper 2 until the annular outer portion 300 of the ferrule 3 abuts against the corresponding portion of the upper surface of the sealing stopper 2. The lower portion of the skirt 31 of the ferrule 3 is then crimped inwardly such that the lower portion of the skirt 31 engages the lower surface of the rim 12 from beneath. Thereafter, the cap is securely mounted to the vial 10, as this is shown in FIG. 2.

As the overseal button 5 is removed for the first time in order to expose the central portion of the sealing stopper 2 not covered by the annular portion 300 of the upper wall 30 of the ferrule 3 (for example in order to allow the needle of a syringe to be pierced through the sealing stopper 2), at least some of the webs 401 connecting the hub 40 of the tamper evidence mechanism 4 to the annular portion 300 break. In case somebody now tries to reassemble the overseal button with the container for whatever reason, for example in order to pretend that the container is in its original state and has not been opened before, or in order to pretend that the particular container comes from a specific manufacturer, this can be easily determined by the consume. The translucent portion of the overseal button allows the consumer to visibly determine whether or not the tamper evidence mechanism is damaged. In the first embodiment described above, the consumer can visibly determine whether or not one or more of the webs 401 are already broken.

Figure 4:
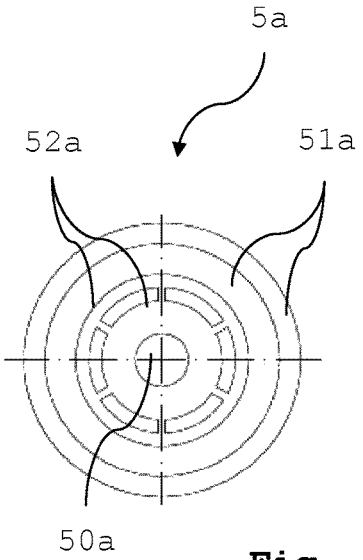
FIG. 4 a top view of a second embodiment of the cap according to the invention (smaller diameter of the opaque hub of the overseal button)

A second embodiment of the cap according to the invention is shown in the top view of FIG. 4. In essence, the components are very similar to those of the first embodiment already described above. The essential difference of the second embodiment of the cap when compared with the first embodiment is, that the opaque colored hub 50*a* of the overseal button 5*a* of the second embodiment has a diameter which is smaller than that of the first embodiment. The opaque colored outer ring 51*a* has the same dimensions as in the first embodiment. As a consequence, the annular translucent portion 52*a* of the overseal button 5*a* of the second embodiment extends radially over a larger area than the annular translucent portion 52 of the overseal button 5 of the first embodiment. The tamper evidence mechanism of the second embodiment is identical with that of the first embodiment.

Figure 5:
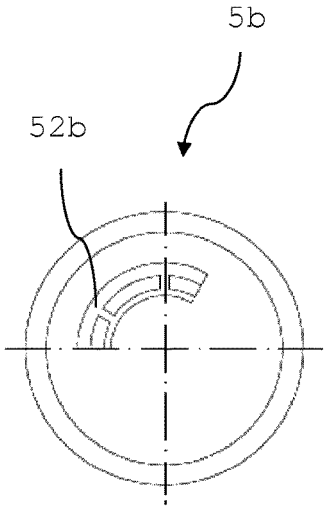
FIG. 5 a top view of a third embodiment of the cap according to the invention (transparent segment of the overseal button extends only over an angular portion)

A third embodiment of the cap according to the invention is shown in the top view of FIG. 5. Again, the components are very similar to those of the afore-described embodiments. However, the essential difference of the third embodiment compared to the afore-described embodiments is that the overseal button 5*b* only comprises a circumferentially running translucent angular segment 52*b* (rather than an entire translucent ring) through which a portion of the tamper evidence mechanism is visible while the rest of the overseal button 5*b* is made of an opaque colored material. In the embodiment shown, the angular segment extends over an angle of about 120°, however, this angle is by way of example only.

Figure 6:
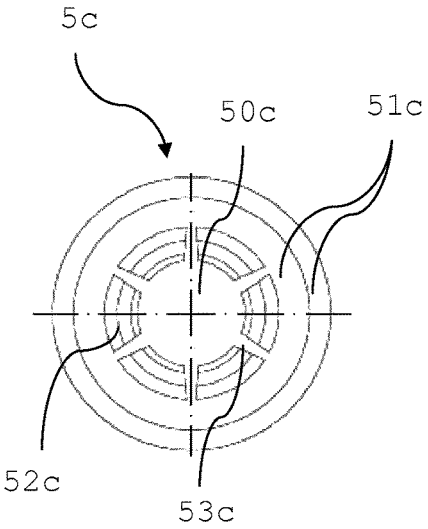
FIG. 6 a top view of a fourth embodiment of the cap according to the invention (overseal button with central opaque hub and star-like opaque spokes)

A fourth embodiment of the cap according to the invention is shown in the top view of FIG. 6. Again, the components are very similar to those of afore-described embodiments. The essential difference of the fourth embodiment compared to the afore-described embodiments is, that the overseal button 5*c* of the fourth embodiment comprises a plurality of opaque colored spokes 53*c* which are arranged to extend from the opaque colored hub 50*c* to the opaque colored outer ring 51*c* in a star-like manner. The tamper evidence mechanism is visible through the translucent annular segments 52*c* extending in circumferential direction between the opaque colored hub 50*c*, the opaque colored outer ring 51*c*, and the opaque colored spokes 53*c*.

Figure 7:
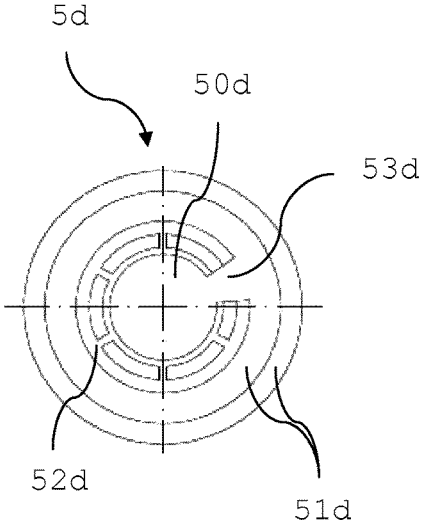
FIG. 7 a top view of a fifth embodiment of the cap according to the invention (overseal button with central opaque hub and conical opaque web)

A fifth embodiment of the cap according to the invention is shown in the top view of FIG. 7. Again the components are very similar to those of the afore-described embodiments. However, the essential difference of the fifth embodiment when compared to the afore-described embodiments is that there is only one single opaque conical web 53*d* extending between the opaque colored hub 50*d* and the opaque colored outer ring 51*d*. The annular translucent portion 52*d* is a ring which is interrupted in circumferential direction only by the opaque colored web 53*d*.

Figure 8:
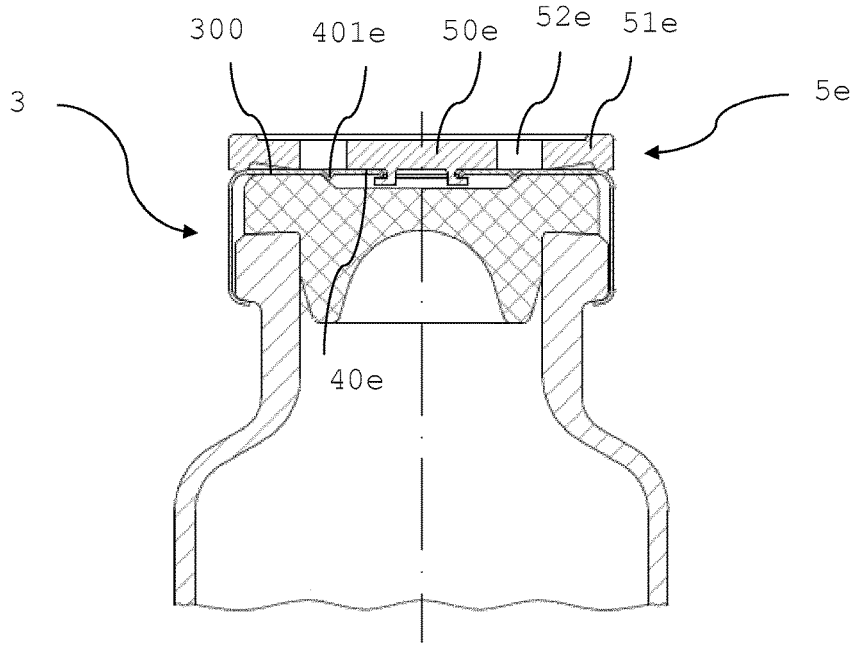
FIG. 8 a sectional view of a container similar to that of FIG. 2, with a sixth embodiment of the cap according to the invention (scoring line as tamper evidence mechanism, and FIG. 9 a top view of the container shown in FIG. 8.
Figure 9:
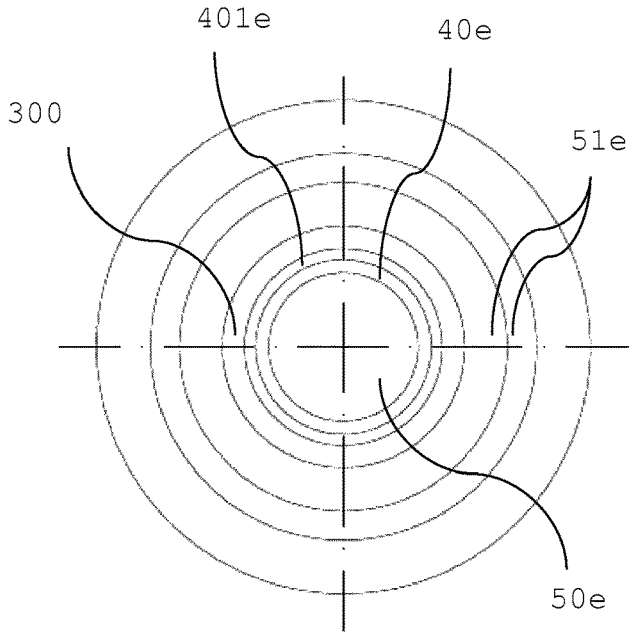

A further embodiment of the container with a sixth embodiment of the cap according to the invention is shown in a sectional view in FIG. 8 and in a top view in FIG. 9. This embodiment differs from the afore-described embodiments in that the tamper evidence mechanism does not comprise any webs connecting the hub 40*e* with the annular outer portion 300 of the upper wall 30 of the ferrule 3. Rather, there is a circumferentially running scoring line 401*e* instead. This scoring line 401*e* is arranged between the hub 40*e* and the annular outer portion 300 of the upper wall of the ferrule 3 and is a weakened portion that breaks as the overseal button 5*e* is removed for the first time. In case this scored line 401*e* has been broken, this is visible to the consumer through the annular translucent portion 52*e* which is arranged between the opaque colored hub 50*e* and the opaque colored outer ring 51*e* of the overseal button 5*e*.

While specific embodiments and combinations of the tamper evidence mechanism and the overseal button have been described with the aid of the drawings, it can be easily understood that the described tamper evidence mechanisms and the overseal buttons can be combined in different manners, as long as it is possible to visibly determine through the translucent portion of the overseal button whether or not a portion of the tamper evidence mechanism is irreversibly damaged. Also, the invention is not limited to any specific type of tamper evidence mechanism. Therefore, the invention is not limited to the embodiments described with the aid of the drawings, but various changes and alterations are possible without departing from the scope of the invention which is defined by the appended claims.

The invention claimed is:

1. A cap for a container containing a pharmaceutical product, the cap comprising:

a ferrule to be fixedly attached to a neck of the container containing a pharmaceutical product, the ferrule comprising an upper wall and a tubular skirt extending downwardly from the upper wall;

a tamper evidence mechanism connected with the ferrule; and an overseal button removably arranged on top of the upper wall of the ferrule in a manner so as to at least fully cover the tamper evidence mechanism, the overseal button being connected to the tamper evidence mechanism such that upon first removal of the overseal button from the ferrule at least a portion of the tamper evidence mechanism is irreversibly damaged, wherein the overseal button comprises at least one translucent portion arranged to extend over the at least one portion of the tamper evidence mechanism which is irreversibly damaged upon first removal of the overseal button from the ferrule, wherein the overseal button further comprises an identification portion which is different from the at least one translucent portion in at least one property, the at least one property being selected such that it allows for visual differentiation of the identification portion and the at least one translucent portion, wherein the overseal button comprises an opaque colored outer ring and the at least one translucent portion is surrounded by the opaque colored outer ring, and wherein the overseal button comprises a centrally arranged opaque colored hub and the at least one translucent portion of the overseal button is arranged between the centrally arranged opaque colored hub and the opaque colored outer ring.

2. The cap according to claim 1, wherein the at least one property of the identification portion allowing for differentiation of the identification portion and the at least one translucent portion is selected from opacity, color, surface roughness, or combinations thereof.

3. The cap according to claim 1, wherein the tamper evidence mechanism comprises a hub and wherein the upper wall of the ferrule comprises an outer portion which is connected to the skirt and surrounds the hub of the tamper evidence mechanism, wherein the hub of the tamper evidence mechanism is connected to the outer portion of the ferrule through a breakable connection, wherein the overseal button comprises a clamping member and wherein the hub comprises a through-opening which is centrally arranged in the hub, with the clamping member of the overseal button extending through the centrally arranged through-opening of the hub and clamping the overseal button to the hub of the tamper evidence mechanism.

4. The cap according to claim 3, wherein the outer portion of the upper wall of the ferrule is an annular portion, wherein the hub of the tamper evidence mechanism is a centrally arranged circular disc comprising the centrally arranged through-opening, and wherein the centrally arranged through-opening has a circular shape.

5. The cap according to claim 4, wherein the breakable connection comprises one or more bridging webs which are connected to the hub of the tamper evidence mechanism as well as to the outer portion of the upper wall of the ferrule, each individual bridging web being arranged at an individual angular position when viewed in circumferential direction, with the individual angular positions of the individual bridging webs being different from one another.

6. The cap according to claim 5, wherein the breakable connection comprises at least four individual bridging webs, in particular at least six individual bridging webs, with the individual bridging webs being arranged at equally spaced individual angular positions, and wherein the at least one translucent portion of the overseal button is arranged to extend over at least one of the bridging webs.

7. The cap according to claim 3, wherein the breakable connection comprises a scoring line connecting the centrally arranged hub of the tamper evidence mechanism to the outer portion of the upper wall of the ferrule, and wherein the translucent portion of the overseal button is arranged to extend at least partly over the scoring line.

8. The cap according to claim 1, wherein the centrally arranged opaque colored hub is connected to the opaque colored outer ring through at least one opaque colored web.

9. The cap according to claim 8, wherein the at least one opaque colored web comprises a plurality of individual opaque spokes arranged to extend from the opaque colored hub to the opaque colored outer ring in a star-like manner.

10. The cap according to claim 9, wherein the at least one opaque colored web comprises a single opaque conical web with the narrow end of the opaque conical web being connected to the opaque colored hub and the wide end of the conical web being connected to the opaque colored outer ring.

11. The cap according to claim 1, wherein the overseal button is a two-component injection molded piece.

12. The cap according to claim 1, wherein the identification portion identifies at least one of a type of the pharmaceutical product, a concentration of the pharmaceutical product, and a manufacturer of the pharmaceutical product.

13. A container containing a pharmaceutical product, the container comprising a neck having an opening for allowing access to the interior of the container, a sealing stopper being arranged in the opening in the neck, and a cap, wherein the cap comprises:

a ferrule comprising an upper wall and a tubular skirt extending downwardly from the upper wall, a tamper evidence mechanism connected with the ferrule; and an overseal button removably arranged on top of the upper wall of the ferrule in a manner so as to at least fully cover the tamper evidence mechanism, the overseal button being connected to the tamper evidence mechanism such that upon first removal of the overseal button from the ferrule at least a portion of the tamper evidence mechanism is irreversibly damaged, wherein the overseal button comprises at least one translucent portion arranged to extend over the at least one portion of the tamper evidence mechanism which is irreversibly damaged upon first removal of the overseal button from the ferrule, wherein the overseal button further comprises an identification portion which is different from the at least one translucent portion in at least one property, the at least one property being selected such that it allows for visual differentiation of the identification portion and the at least one translucent portion, wherein the cap is arranged to cover the sealing stopper with the lower end of the skirt of the cap engaging a rim on an outer wall of the neck of the container containing a pharmaceutical product, wherein the overseal button comprises an opaque colored outer ring, the at least one translucent portion being surrounded by the opaque colored outer ring, and wherein the overseal button comprises a centrally arranged opaque colored hub and the at least one translucent portion of the overseal button is arranged between the centrally arranged opaque colored hub and the opaque colored outer ring.

14. The container according to claim 13, wherein the at least one property is selected from opacity, color, surface roughness, and combinations thereof.

15. The container according to claim 13, wherein the tamper evidence mechanism comprises a hub, the upper wall of the ferrule comprising an outer portion that is connected to the skirt and surrounds the hub, the hub being connected to the outer portion of the ferrule through a breakable connection, the overseal button comprising a clamping member, the hub comprising a through-opening that is centrally arranged in the hub, the clamping member of the overseal button extending through the centrally arranged through-opening of the hub and clamping the overseal button to the hub.

16. The container according to claim 15, wherein the outer portion of the upper wall is an annular portion, the hub of the tamper evidence mechanism being a centrally arranged circular disc comprising the centrally arranged through-opening, the centrally arranged through-opening having a circular shape.

17. The container according to claim 16, wherein the breakable connection comprises one or more bridging webs which are connected to the hub and to the outer portion of the upper wall, each individual bridging web being arranged at an individual angular position when viewed in circumferential direction, with the individual angular positions of the individual bridging webs being different from one another.

18. The container according to claim 17, wherein the breakable connection comprises at least four individual bridging webs, in particular at least six individual bridging webs, with the individual bridging webs being arranged at equally spaced individual angular positions, and wherein the at least one translucent portion of the overseal button is arranged to extend over at least one of the bridging webs.

19. The container according to claim 15, wherein the breakable connection comprises a scoring line connecting the centrally arranged hub of the tamper evidence mechanism to the outer portion of the upper wall of the ferrule, the translucent portion of the overseal button being arranged to extend at least partly over the scoring line.

20. The container according to claim 13, wherein the centrally arranged opaque colored hub is connected to the opaque colored outer ring through at least one opaque colored web.

21. The container according to claim 20, wherein the at least one opaque colored web comprises a plurality of individual opaque spokes arranged to extend from the opaque colored hub to the opaque colored outer ring in a star-like manner.

22. The container according to claim 21, wherein the at least one opaque colored web comprises a single opaque conical web with the narrow end of the opaque conical web being connected to the opaque colored hub and the wide end of the conical web being connected to the opaque colored outer ring.

23. The container according to claim 13, wherein the overseal button is a two-component injection molded piece.

24. The container according to claim 13, wherein the container is a vial configured to store and administer the pharmaceutical product.

* * * * *